US007815421B2

(12) United States Patent
Bross et al.

(10) Patent No.: US 7,815,421 B2
(45) Date of Patent: Oct. 19, 2010

(54) CHANNEL FORM FOR A ROTATING PRESSURE EXCHANGER

(75) Inventors: Stephan Bross, Erpolzheim (DE); Wolfgang Kochanowski, Windesheim (DE)

(73) Assignee: KSB Aktiengesellschaft, Frankenthal (DE)

( * ) Notice: Subject to any disclaimer, the term of this patent is extended or adjusted under 35 U.S.C. 154(b) by 0 days.

(21) Appl. No.: 11/703,226

(22) Filed: Feb. 7, 2007

(65) Prior Publication Data

US 2007/0212231 A1 Sep. 13, 2007

Related U.S. Application Data

(63) Continuation of application No. PCT/EP2005/007644, filed on Jul. 14, 2005.

(30) Foreign Application Priority Data

Aug. 7, 2004 (DE) ..... 10 2004 038 439

(51) Int. Cl.
*F04F 13/00* (2009.01)

(52) U.S. Cl. ..... 417/64; 417/92; 417/375; 417/405

(58) Field of Classification Search ..... 417/64; 60/39.45
See application file for complete search history.

(56) References Cited

U.S. PATENT DOCUMENTS 2,399,394 A * 4/1946 Claude Seippel ..... 60/39.45
2,867,981 A * 1/1959 Berchtold ..... 60/39.45
3,431,747 A 3/1969 Hasheml et al.
4,887,942 A * 12/1989 Hauge ..... 417/64
4,900,222 A * 2/1990 Meng et al. ..... 415/143
5,338,158 A * 8/1994 Hauge ..... 417/64
5,988,993 A * 11/1999 Hauge ..... 417/365
6,537,035 B2 3/2003 Shumway
6,540,487 B2 * 4/2003 Polizos et al. ..... 417/65

FOREIGN PATENT DOCUMENTS

| | | |
|---|---|---|
| CH | 344872 | 2/1960 |
| GB | 803659 | 10/1958 |
| GB | 921686 | 3/1963 |
| WO | WO 91/06781 | 5/1991 |

OTHER PUBLICATIONS

English translation of Form PCT/IB/338 and PCT/IPEA/409 (Six (6) pages), Apr. 3, 2007.

* cited by examiner

*Primary Examiner*—Devon C Kramer
*Assistant Examiner*—Philip Stimpert
(74) *Attorney, Agent, or Firm*—Crowell & Moring LLP

(57) ABSTRACT

A pressure exchanger transferring pressure energy from a liquid in a first liquid system to a liquid in a second liquid system, having a housing with inlet and outlet connection openings for each liquid and a rotor arranged in the housing for rotation about a longitudinal axis. Through rotor channels are arranged around the rotor longitudinal axis with openings on each axial end face of the rotor. The rotor channels are arranged for connection through opposing flow openings facing the housing to the connection openings of the housing. During rotor rotation high pressure liquid and low pressure liquid are alternately introduced into the respective systems. Liquid flowing to the rotor through the openings generates a circumferential force ($c_u$) for driving the rotor, and starting at or following the openings a flow guiding configuration formed as a rotor channel flow diverting contour is arranged in the rotor channels.

5 Claims, 4 Drawing Sheets

CHANNEL FORM FOR A ROTATING PRESSURE EXCHANGER

CROSS REFERENCE TO RELATED APPLICATIONS

This application is a continuation of international patent application no. PCT/EP2005/007644, filed Jul. 14, 2005 designating the United States of America, and published in German on Feb. 16, 2006 as WO 2006/015681, the entire disclosure of which is incorporated herein by reference. Priority is claimed based on Federal Republic of Germany patent application no. DE 10 2004 038 439.8, filed Aug. 7, 2004.

BACKGROUND OF THE INVENTION

The present invention relates to a pressure exchanger for the transfer of pressure energy from a first liquid of a first liquid system to a second liquid of a second liquid system, comprising a housing with connector openings in the form of inlet and outlet openings for each liquid and a rotor arranged inside the housing to rotate about its longitudinal axis, said rotor having a plurality of continuous rotor channels with openings arranged around its longitudinal axis on each rotor end face, the rotor channels communicating with the connector openings of the housing through flow openings in the housing such that they alternately carry liquid at a high pressure and liquid at a low pressure to the respective systems during the rotation of the rotor.

A pressure exchanger of this general type is known from U.S. Pat. No. 6,540,487 B2. This type of pressure exchanger is not equipped with an external drive. To start operation, a complex method is required to cause such a pressure exchanger to start rotation of the rotor. The liquid stream is primarily responsible for the rotational movement of the rotor, passing through the flow openings in the housing from an oblique direction and striking the end faces of the rotor and the openings therein. During ongoing operation in a continuously operated system, an equilibrium state will develop in the pressure exchanger, so that the rotor rotates at an approximately constant rotational speed. Disadvantages of this design include a restricted operating range and mixing of the two liquids, which are found alternately in the rotor channels during operation.

U.S. Pat. No. 3,431,747 A and U.S. Pat. No. 6,537,035 B2 describe pressure exchangers in which the movement of the rotor is started by an external drive, and the rotor channels are constructed as bores with a ball arranged in each bore. This ball serves to separate the liquids flowing alternately into the rotor channels with a high pressure or a low pressure and to prevent mixing of the liquids in the bores. However, the disadvantages of this design include the arrangement, sealing and design of the ball, which acts as a separating element, and the respective seating. In addition, a complex high-pressure seal is required as a shaft seal in the area of a shaft bushing for the external drive.

SUMMARY OF THE INVENTION

It is an object of the present invention to provide an improved rotating pressure exchanger.

Another object of the invention is to provide a pressure exchanger in which reduced mixing losses occur during a pressure exchange.

A further object of the invention is to provide a rotating pressure exchanger rotor channel configuration which generates a force for driving the rotor.

These and other objects are achieved in accordance with the present invention by providing a pressure exchanger for transferring pressure energy from a high pressure liquid of a first liquid system to a low pressure liquid of a second liquid system, comprising a housing with inlet and outlet connection openings for each liquid and a rotor arranged in the housing to rotate about a longitudinal axis; the rotor having a plurality of continuous rotor channels having openings on each rotor end face arranged around the longitudinal axis of the rotor with the rotor channels communicating with the connection openings of the housing via flow openings formed in the housing such that during the rotation of the rotor the rotor channels alternately carry high pressure liquid and low pressure liquid from the respective first and second liquid systems, wherein oncoming liquid flow to the rotor through the flow openings formed in the housing in the rotating relative system of the rotor establishes a circumferential force component that drives the rotor, and wherein a flow guiding shape in the form of a channel contour that deflects the rotor channel flow is arranged in the inlet area of the rotor channels starting at or downstream from the channel openings.

In accordance with the invention, a flow guiding shape in the form of a channel contour that deflects the rotor channel flow is provided in the rotor channels, starting from or downstream from the openings. This flow guiding shape ensures impact-free oncoming flow to the rotor channels. As a result of this, flows with a uniform velocity distribution over a channel cross section are established in the rotor channels. Due to the uniform velocity distribution, development of flow components running across the channel flow in the channel cross section is prevented. Such flow components running transversely initiate development of eddies within a flowing column of liquid and running across the column, ultimately causing the mixing effect which occurs within the rotor channels. In systems, particularly desalination systems, in which production of a pure liquid is the goal, mixing is a deleterious aspect. The driving torque for the rotor is achieved by a direct transfer of momentum from the incoming flow and to a rotor end face through the impact-free flow deflection in the area of the channel openings. This is in complete contradiction with the approaches known in the past.

The risk of mixing in the rotor channels is further reduced if the shape provided in the inlet area of the rotor channels is constructed as a channel contour that makes the channel flow more uniformly. As a result, a velocity profile having an approximately homogeneous velocity field is established in 20-30% of the total length of a tube channel within a rotor channel downstream from the inlet area.

With the rotor channels, the inlet openings and/or the channel beginnings downstream from them have a shape that equalizes the flows in the rotor channels. This also yields a uniform velocity profile in the rotor channels, so that mixing of the two different pressure exchanging liquids in the rotor channels is minimized.

In the design stage for inlets into the rotor channels, the flow ratios are based on velocity triangle diagrams in which the circumferential component $c_u$ generates a driving torque for the rotor as a momentum force. This circumferential component is designed to be larger than the circumferential velocity U of the rotor. The rotor inlet edges formed between the openings of the rotor channels with the wall surfaces which follow in the direction of flow are constructed so that the resulting relative flow of the rotor is received without impact by the rotor channels and is deflected in the direction of the rotor channel length.

Such a design of the inlet of the rotor channels also includes the advantage that when there is a change in volume flow, the triangle diagram of the velocity at the inlet of the rotor channels undergoes an affine change, i.e., the circumferential component $c_u$ changes to the same extent as the oncoming flow velocity c of the liquid. Thus the driving torque acting on the rotor also increases, leading to an increase in the rotor rpm. With an increase in rotor rpm, the frictional moment acting on the rotor and having a retarding effect also increases. Due to the linear relationship between the driving torque $M_I$ which increases with an increase in the circumferential component $c_u$ and the frictional moment $M_R$ which increases in proportion to the rotational speed, the circumferential velocity of the rotor is always established so that the triangle diagrams of the velocity conditions which prevail at the rotor inlet are similar for all volume flows. There is thus a self-regulating effect which guarantees the condition of impact-free oncoming flow for each volume flow established. The rotational speed of the rotor is thus corrected based on the congruent velocity triangle diagrams and an impact-free oncoming flow of the rotor channels for volume flows of the main flows that are altered due to system conditions.

According to another embodiment, a rotor is constructed in multiple parts, whereby a rotor part having straight rotor channels on its end faces is provided with one or two incoming flow plates, and inlet openings and/or downstream channel beginnings which make the channel flows uniform are arranged in the incoming flow plates.

BRIEF DESCRIPTION OF THE DRAWINGS

The invention will be described in further detail hereinafter with reference to illustrative preferred embodiments shown in the accompanying drawing figures, in which.

DETAILED DESCRIPTION OF PREFERRED EMBODIMENTS

Figure 1:
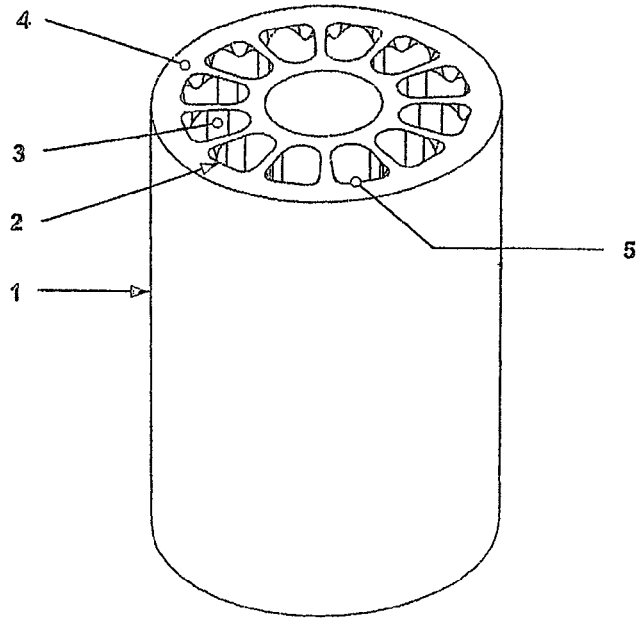
Fig. 1 PRIOR ART
FIG. 1 is a perspective view of a prior art rotor according to U.S. Pat. No. 6,540,487.

FIG. 1 shows a perspective view of a prior art cylindrical rotor 1 according to U.S. Pat. No. 6,540,487. Rotor channels 2 having a trapezoidal cross section are arranged so they are axially parallel to and concentric with the axis of rotation of the rotor 1, with wall surfaces 3 designed as webs running radially between the rotor channels 2 extending between the rotor channels 2. The openings 5 in the rotor channels 2 arranged on the end face 4 of the rotor 1 have additional rounded surfaces on their radially outer corners in the manner of inclined surfaces that widen diagonally outward, so that each opening is slightly enlarged. There is no diagram here of a housing surrounding the rotor or its connections for the lines, nor are the flow guiding transitions from the housing to the rotor shown here.

Figure 2:
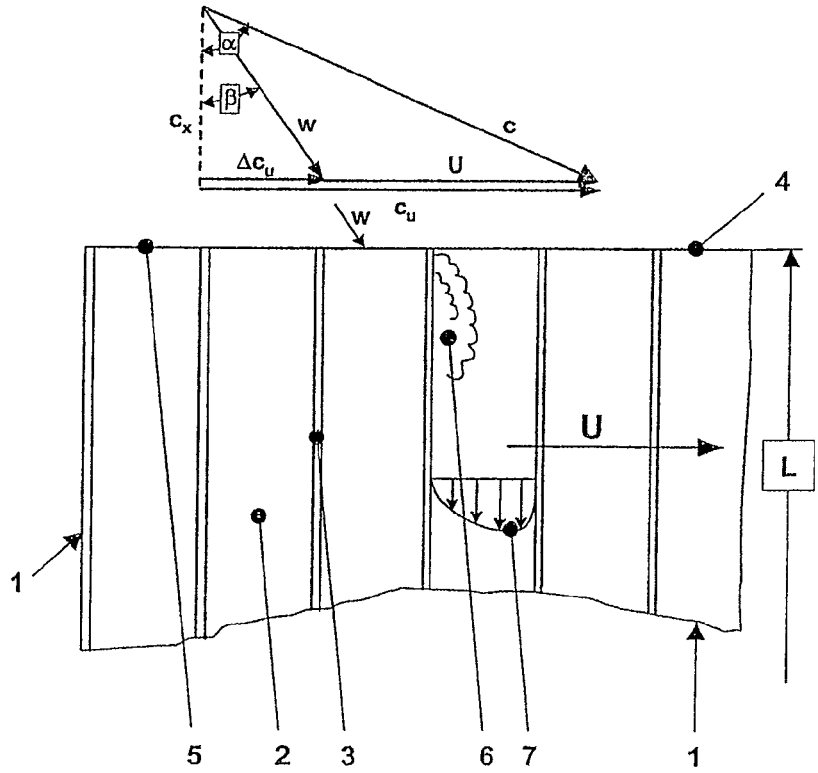
Fig. 2 PRIOR ART
FIG. 2 is a developed view of the rotor of FIG. 1 with a triangle diagram of the flow velocity at the beginnings of the rotor channels.

FIG. 2 shows the developed view of the rotor 1 of the prior art pressure exchanger illustrated in FIG. 1. Opposite the openings of the rotor 1 with its axially parallel rotor channels 2, this figure shows the velocity triangle diagram for a liquid flowing into the rotor 1, comprising velocity vectors U, w and c, where the arrows indicate the directions and the magnitudes of the various velocities, where:

U=circumferential velocity of the rotor w=relative flow in the opening upstream from the rotor channel c=absolute flow of the liquid flowing out of the housing and to the rotor, where:

$c_u$=circumferential component of the absolute flow and $c_x$=axial component of the absolute flow, $\Delta c_u$=driving velocity for the rotor=$c_u$−U α=angle of flow of the absolute flow c β=angle of flow of the relative flow The flow to the rotor 1 is passed through a housing part opposite the rotor (not shown) which is opposite the rotor so that the flow in the stationary reference system strikes the rotor 1 as an absolute flow c at the angle α. The rotor 1 rotates with the circumferential velocity U and accordingly the relative flow w strikes it at the angle β. The circumferential component $c_u$ of the absolute flow c is greater by $\Delta c_u$ than the circumferential velocity U of the rotor, thus ensuring the required driving torque of the rotor 1.

Because of the relative oncoming flow angle β, which is different from zero, the oncoming flow of the rotor channels 2 in the relative system is not free of impact. Consequently, separations 6 in the form of eddies are constantly developing in the openings 5 in the rotor channels 2 and as a result an irregular velocity profile 7 is established within the flow in the remaining path of the rotor channels 2. These irregular velocity profiles 7 lead to the mixing problems associated with pressure exchangers known previously.

Figure 3:
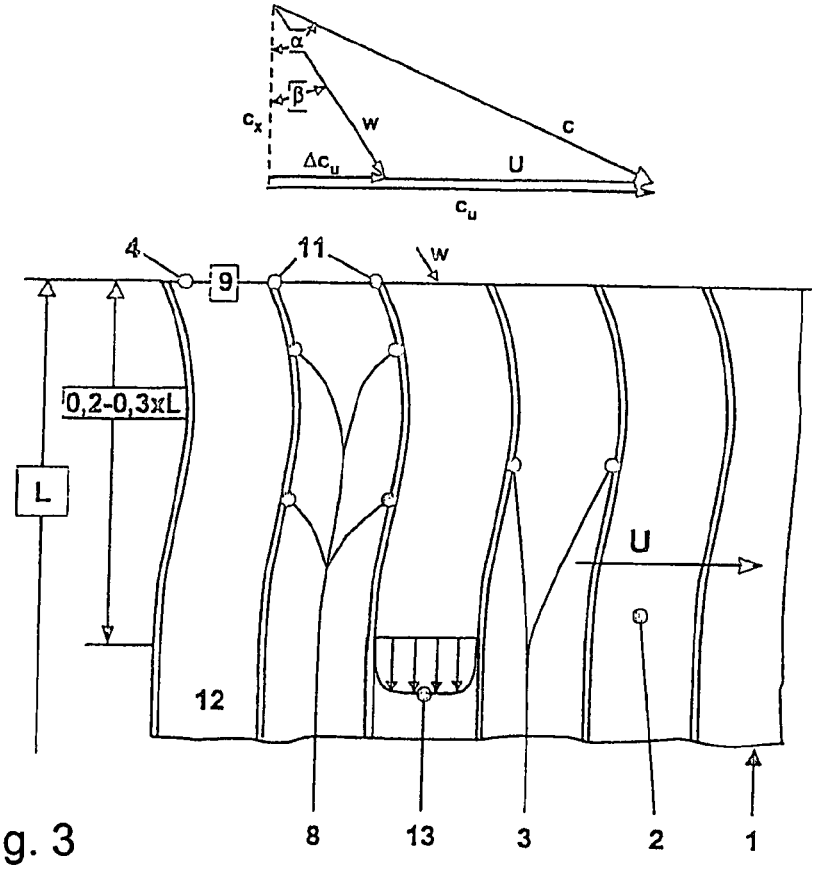
FIG. 3 is a diagram of a new rotor channel inlet opening shape according to the present invention.

As the developed view of a new rotor form, FIG. 3 shows the shape 8 of the rotor channels 2 in their inlet area and starting from the end face 4. The respective velocity triangle diagram corresponds in size and direction to that according to the state of the art as shown in FIG. 2. All the corresponding velocity triangle diagrams in the figures are based on the same operating conditions.

In FIG. 3 the shape of the rotor channels 2 in the inlet area 9 of a rotor 1 is constructed in accordance with the shape 8 so that the rotor inlet edges 11 with their downstream wall surfaces 3 do not extend perpendicular to the end face 4 but instead run at an angle and correspond to the flow angle β of the relative oncoming flow w. Consequently, the relative oncoming flow w strikes the rotor inlet edges 11 tangentially. It thus strikes the rotor inlet edges 11 without impact and consequently enters the rotor channels 2 without impact. The subsequent deflection of the flow in the shape 8 and in the direction of the channel axes or in the direction of the channel length takes place along the first 20-30% of the total channel length L. At the end of the deflection, there is a transition 12 to the subsequent channel form which has a normal design running axially, constructed to ensure a uniform homogeneous velocity profile 13 in the rotor channel 2.

Due to the linear relationship between the circumferential component $c_u$ and thus the difference $\Delta c_u = c_u - U$, and the driving angular momentum $M_I$ according to the equation $$M_I \sim \Delta c_u \cdot c_x \tag{1}$$

and the linear relationship between the friction torque $M_R$ braking the rotor 1 with the rotor circumferential velocity U according to the equation $$M_R \sim \nu \cdot U \tag{2}$$

where v represents the dynamic viscosity, the rotor rpm in this inlet design of a rotor channel form is always established as a function of the volume flow, so that the state of impact-free oncoming flow remains guaranteed for each operating point.

Figure 4:
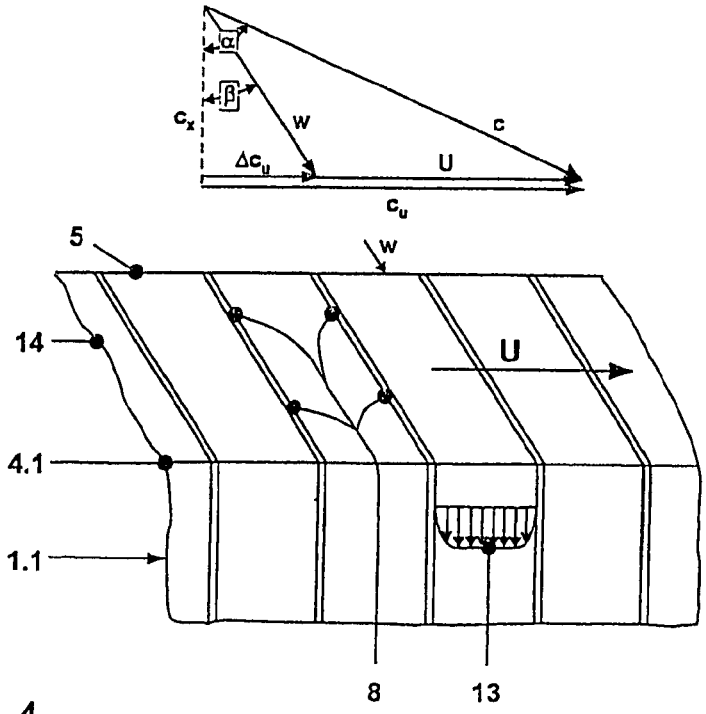
FIG. 4 shows a rotor similar to that of FIG. 3 having a multipart construction.

FIG. 4 shows a design of the openings 5 of a rotor 1, which has been simplified from the technical manufacturing standpoint in comparison with the rotor of FIG. 3. The end face 4 of the rotor 1 with the openings 5 is constructed in this case here as a part of a separate component in the form of an incoming flow plate 14. The incoming flow plate 14 with the shapes 8 for impact-free admission of the relative flow into the rotor channels 2 is applied to the rotor core 1.1 which is provided with axially extending rotor channels 2. These incoming flow plates 14 may be mounted on one or both sides of a rotor with rotor channels running axially. This is performed according to the design of the pressure exchanger. For the connection of incoming flow plates 14 and rotor 1 or rotor core 1.1, known connecting techniques may be used, depending on the materials that are used.

Figure 5:
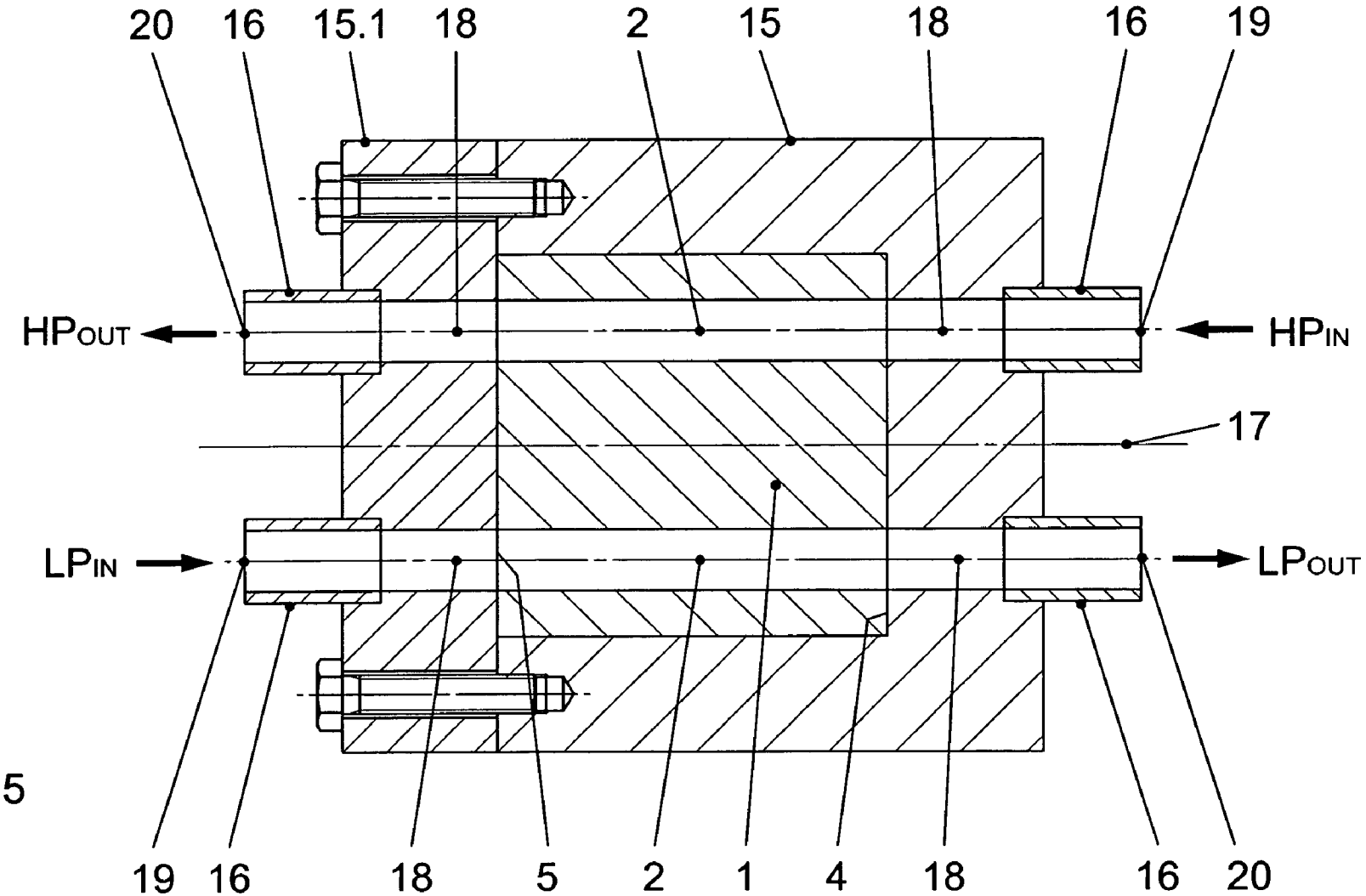
FIG. 5 is a sectional view of a rotary pressure exchanger containing a rotor according to FIG. 3.

FIG. 5 shows a pressure exchanger for transferring pressure energy from a first, high pressure liquid system to a second, lower pressure liquid system comprising a housing 15, 15.1 with inlet and outlet connection openings 19 and 20, respectively, with connecting nipples 16 for each liquid and a rotor 1 according to FIG. 3 arranged inside the housing for rotation about its longitudinal axis 17 Surrounding the longitudinal axis of the rotor are a plurality of liquid channels 2 extending through the rotor 1, the angle of view in this figure being such that the flow deflecting curved configuration of the ends of the channels is not visible because it projects perpendicular to the plane of the drawing. The channels 2 have openings 5 at each axial end face 4 thereof which communicate through flow openings 18 formed in the housing with the housing inlet and outlet connection openings in such a way that during the rotation of the rotor, liquid at high pressure from the first liquid system and liquid a low pressure from the second liquid system are alternatingly introduced into the channels 2.

Figure 6:
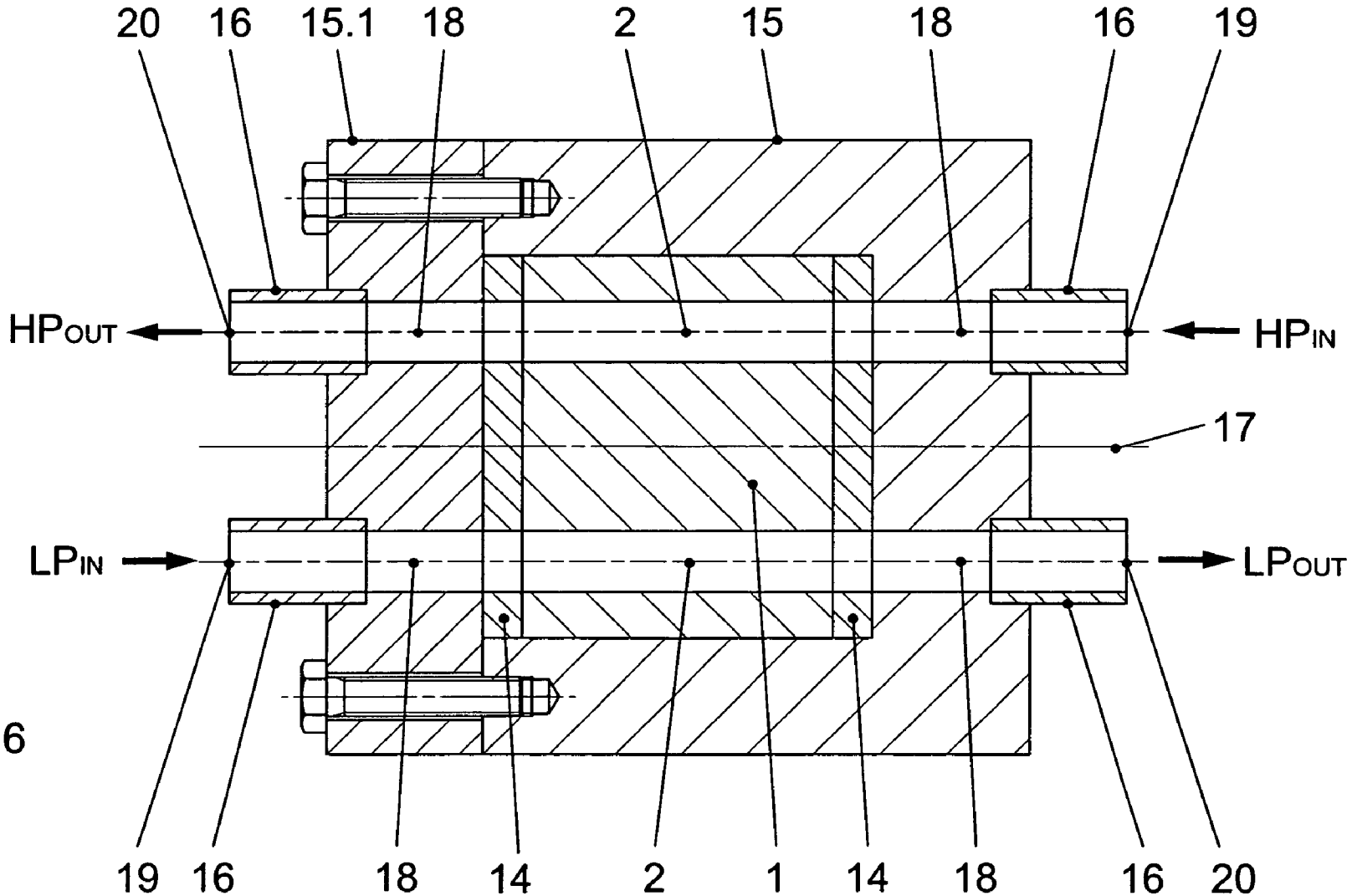
FIG. 6 is a sectional view of a rotary pressure exchanger according to the invention containing a rotor according to FIG. 4.

In similar vein, FIG. 6 likewise shows a pressure exchanger for transferring pressure energy from a first, high pressure liquid system to a second, lower pressure liquid system comprising a housing 15, 15.1 with inlet and outlet connection openings 19 and 20, respectively, with connecting nipples 16 for each liquid and a rotor 1 arranged inside the housing for rotation about its longitudinal axis 17, except that this time the rotor is constructed in accordance with FIG. 4. Again surrounding the longitudinal axis of the rotor are a plurality of liquid channels 2 extending through the rotor 1 with the liquid guiding shapes formed in flow guiding rotor end plates 14, in this case disposed at both ends of the rotor 1. As in FIG. 5, the angle of view in this figure is such that the angled configuration of the ends of the channels is not visible because it projects perpendicular to the plane of the drawing. In other respect, the pressure exchanger of FIG. 6 corresponds to that illustrated in FIG. 5.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations within the scope of the appended claims and equivalents thereof.

What is claimed is:

1. A pressure exchanger for transferring pressure energy from a high pressure liquid of a first liquid system to a low pressure liquid of a second liquid system, comprising:

a housing with inlet and outlet connection openings for each liquid, and a rotor arranged in the housing to rotate about a longitudinal axis, the rotor having a plurality of continuous rotor channels extending axially and having openings on each rotor end face arranged around the longitudinal axis of the rotor with the rotor channels communicating through flow openings formed in the housing with the connection openings of the housing such that during the rotation of the rotor the rotor channels alternately carry high pressure liquid and low pressure liquid from the respective first and second liquid systems, wherein oncoming liquid flow from the flow openings formed in the housing to the rotor channels exerts a circumferential force component on the rotor that drives the rotor, wherein flow guiding shapes in the form of channel contours that deflect the rotor channel flow are arranged in the inlet areas of the rotor channels starting at or downstream from the channel openings, and wherein the flow guiding shapes arranged in the inlet areas of the rotor channels are constructed as channel contours that ensure uniform homogeneous velocity profiles in the rotor channels, each of said channel contours having a section with an axis not parallel to said longitudinal axis, each section in the inlet areas being deflected in a direction of rotation of the rotor.

2. A pressure exchanger according to claim 1, wherein each flow deflecting channel contour has a length amounting to from about 20 to about 30% of the total length of the rotor channel, and a velocity profile having an approximately homogeneous velocity field develops downstream from the channel inlet area.

3. A pressure exchanger according to claim 2, wherein the oncoming flow of liquid to the rotor and the openings of the rotor channels are aligned such that the oncoming liquid enters the rotor channels without impact.

4. A pressure exchanger according to claim 1, wherein rotor inlet edges formed between the openings of the rotor channels and rotor wall surfaces downstream of the channel openings in the direction of liquid flow are angled such that the relative oncoming flow which is directed against the rotor enters the rotor channels without impact and the rotor wall surfaces downstream of the channel openings deflect the flow in the direction of the rotor channel length.

5. A pressure exchanger according to claim 1, wherein the rotor is constructed of multiple parts, such that a rotor part having straight rotor channels at its end faces is provided at one end with at least one incoming flow plate, said at least one incoming flow plate having openings or channel inlet portions arranged therein which deflect the channel flows and make the channel flows uniform.

* * * * *